US007802453B2

(12) United States Patent
Oh et al.

(10) Patent No.: US 7,802,453 B2
(45) Date of Patent: Sep. 28, 2010

(54) WASHING MACHINE

(75) Inventors: Soo Young Oh, Seoul (KR); Kyung Chul Woo, Seoul (KR); Jin Woong Kim, Gyeonggi-Do (KR); Si Moon Jeon, Seoul (KR); Na Eun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/155,881

(22) Filed: Jun. 11, 2008

(65) Prior Publication Data

US 2008/0250824 A1 Oct. 16, 2008

Related U.S. Application Data

(63) Continuation of application No. 10/753,498, filed on Jan. 9, 2004, now Pat. No. 7,406,842.

(30) Foreign Application Priority Data

Aug. 13, 2003 (KR) ..... 2003-56232
Nov. 27, 2003 (KR) ..... 2003-85271

(51) Int. Cl.
*D06F 39/08* (2006.01)

(52) U.S. Cl. ..... 68/12.02; 68/12.12; 68/15

(58) Field of Classification Search ..... 68/15, 68/207; 134/184, 198
See application file for complete search history.

(56) References Cited

U.S. PATENT DOCUMENTS 1,396,268 A * 11/1921 Dunkley ..... 426/287
1,487,907 A * 3/1924 Yates ..... 68/58
1,501,746 A * 7/1924 Carter ..... 68/139
1,536,230 A * 5/1925 McCue ..... 239/520
1,646,299 A 10/1927 Mandry
1,947,752 A * 2/1934 Benesh ..... 239/523
2,355,882 A * 8/1944 Malsbary et al. ..... 239/137
2,404,450 A * 7/1946 Meyer ..... 68/58
2,516,282 A * 7/1950 Wilton ..... 239/273

(Continued)

FOREIGN PATENT DOCUMENTS

DE 195 46 967 A1 6/1997

(Continued)

OTHER PUBLICATIONS

European Patent Office 0 816 550 Jul. 1997.*

*Primary Examiner*—Frankie L Stinson
(74) *Attorney, Agent, or Firm*—Birch, Stewart, Kolasch & Birch, LLP

(57) ABSTRACT

A washing machine includes: a steam generator for generating steam; a circulation pump for pumping circulation water discharged from a tub and re-supplying it into a drum; a spray nozzle for spraying steam generated from the steam generator and the circulation water pumped from the circulation pump into the drum; and a back-current preventing branch unit connected to the steam generator by a steam supply line, connected to the circulation pump by a circulation line, and connected to the spray nozzle. With this structure, circulation water circulated by the circulation unit and steam generated from the steam generator are sprayed to the laundry through one spray nozzle, so that a system can be simplified and a fabrication cost can be reduced.

16 Claims, 9 Drawing Sheets

U.S. PATENT DOCUMENTS

| | | | | | |
|---|---|---|---|---|---|
| 2,574,900 | A | * | 11/1951 | Williams et al. | 34/552 |
| 2,585,608 | A | * | 2/1952 | Wieghart | 239/251 |
| 2,925,223 | A | * | 2/1960 | Reddick et al. | 239/441 |
| 3,443,406 | A | * | 5/1969 | Hornback et al. | 68/58 |
| 3,473,175 | A | | 10/1969 | Sieber | |
| 3,672,188 | A | | 6/1972 | Geschka et al. | |
| 3,705,602 | A | | 12/1972 | Nordin et al. | |
| 3,776,471 | A | * | 12/1973 | Meyer et al. | 239/553.5 |
| 3,935,719 | A | * | 2/1976 | Henderson | 68/58 |
| 4,187,138 | A | | 2/1980 | Thwaites et al. | |
| 4,204,339 | A | | 5/1980 | Muller et al. | |
| 4,311,160 | A | | 1/1982 | Charland et al. | |
| 4,643,775 | A | * | 2/1987 | Reba et al. | 134/15 |
| 4,941,333 | A | * | 7/1990 | Blessing | 68/19.2 |
| 5,130,078 | A | | 7/1992 | Dillman | |
| 5,161,394 | A | | 11/1992 | Felzer et al. | |
| 5,313,811 | A | | 5/1994 | Wasinger et al. | |
| 5,491,857 | A | | 2/1996 | Love, III et al. | |
| 5,953,939 | A | | 9/1999 | Guerrero-Parra et al. | |
| 6,006,398 | A | | 12/1999 | Larson et al. | |
| 6,161,306 | A | * | 12/2000 | Clodic | 34/321 |
| 6,397,874 | B1 | | 6/2002 | Featheringill et al. | |
| 7,021,087 | B2 | * | 4/2006 | France et al. | 68/17 R |
| 2004/0261824 | A1 | | 12/2004 | Eiermann | |

FOREIGN PATENT DOCUMENTS

| | | | | |
|---|---|---|---|---|
| EP | 1 275 767 | A1 | | 1/2003 |
| GB | 10423 | A | | 0/1909 |
| GB | 21024 | A | | 0/1910 |
| GB | 1 271 074 | | * | 4/1972 |
| GB | 21286 | A | | 6/1998 |
| GB | 2 348 213 | A | | 9/2000 |
| GB | 2 366 809 | | * | 3/2002 |
| JP | 59-000095 | | * | 1/1984 |
| JP | 61-128995 | | * | 6/1986 |
| JP | 2-239894 | A | | 2/1990 |
| JP | 11-115033 | | * | 4/1999 |
| JP | 2000-0176192 | A | | 6/2000 |
| JP | 2003-019382 | A | | 1/2003 |
| JP | 2003-93775 | | * | 4/2003 |
| JP | 2003-093775 | A | | 4/2003 |
| JP | 2003-311084 | A | | 11/2003 |
| KR | 1989-0006163 | Y1 | | 6/1988 |
| KR | 20-1992-0002655 | U | | 2/1992 |
| KR | 20-1993-0019820 | U | | 9/1993 |
| KR | 10-1996-0034538 | A | | 10/1996 |
| KR | 10-1997-0070295 | A | | 11/1997 |
| KR | 20-0163130 | Y1 | | 9/1999 |
| KR | 10-2003-0055963 | A | | 7/2003 |
| SU | 1669724 | | * | 8/1991 |
| WO | WO-03-012185 | A2 | | 2/2003 |
| WO | WO 03-055373 | A1 | | 7/2003 |

* cited by examiner

WASHING MACHINE

The present application is a continuation application of Prior application Ser. No. 10/753,498, filed Jan. 9, 2004, currently pending, which claims priority under 35 U.S.C. §119(a) on Patent application No(s). 2003-0056232 and 2003-0085271 filed in Korea on Aug. 13, 2003 and Nov. 27, 2003, respectively, the entire contents of which are hereby incorporated by reference.

BACKGROUND OF THE INVENTION

1. Field of the Invention

The present invention relates to an apparatus for heating the laundry of a washing machine and, more particularly, to a washing machine for heating the laundry by directly spraying steam to the laundry.

2. Description of the Background Art

FIG. 1 is a sectional view of a drum washing machine in accordance with a conventional art.

The conventional washing machine includes a cabinet 102 forming the exterior, a tub 104 positioned inside the cabinet 102 and storing water, a drum 106 rotatably disposed inside the tub 104 and performing washing and dewatering operation of the laundry, and a driving motor 110 connected to the drum 106 by a driving shaft 108 and rotating the drum 106.

The tub 104 is buff-supported by dampers 120 and 122 inside the cabinet 102, and a heater 130 for heating water stored in the tub 104 is installed at a lower side of the tub 104.

Herein, a sufficient space is to be secured for installing the heater 130 between the tub 104 and the drum, and the water level inside the tub 104 needs to be maintained by more than a predetermined amount so that the heater 130 can be sufficiently soaked in water.

The operation of the conventional drum washing machine will now be described.

When the washing machine is driven, water is supplied into the tub 104, and when the water level in the tub reaches a pre-set level, the heater 130 is operated to heat water. And the driving motor 110 is moved forwardly and backwardly at the same time when the water is heated by the heater 130, thereby performing a washing operation. When the temperature of water reaches a pre-set temperature, the heater 130 is turn off.

However, the conventional washing machine has a problem that since a receiving space should be obtained at the lower side of the tub 104 in order to install the heater 130 therein for heating the laundry, the overall size of the washing machine is increased, and in addition, since water is filled in the heater-received space, water is much wasted.

In addition, since water is heated by the heater 130, a power consumption of the heater 130 is increased, use amount of detergent is increased, and washing time is lengthened.

SUMMARY OF THE INVENTION

Therefore, one object of the present invention is to provide a washing machine capable of reducing an overall size and the amount of water, minimizing power consumption, and shortening a washing time by heating the laundry by spraying stream directly to the laundry.

Another object of the present invention is to provide a heating device of a washing machine capable of simplifying a system and reducing a fabrication cost by spraying circulation water circulated by a circulation unit and steam generated from a steam generator through one spray nozzle to the laundry.

To achieve these and other advantages and in accordance with the purpose of the present invention, as embodied and broadly described herein, there is provided a washing machine including: a steam generator for generating steam; a circulation pump for pumping circulation water discharged from a tub and re-supplying it into a drum; a spray nozzle for spraying steam generated from the steam generator and the circulation water pumped from the circulation pump into the drum; and a back-current preventing branch unit connected to the steam generator by a steam supply line, connected to the circulation pump by a circulation line, and connected to the spray nozzle, so as to prevent circulation water supplied to the spray nozzle from flowing back to the steam supply line or steam supplied to the spray nozzle from flowing back to the circulation line.

The back-current preventing branch unit includes: a steam supply unit connected to the steam supply line and receiving steam; a circulation water supply unit connected to the circulation line and receiving circulation water; a nozzle connection unit communicating with the steam supply unit and the circulation water supply unit so as to be connected to the spray nozzle; and a back-current for preventing the steam supply unit or the circulation water supply unit to prevent plate for preventing steam or circulation water from flowing backward.

The spray nozzle includes a flange unit engaged with the nozzle connection unit; a nozzle unit formed at a lower side of the flange unit and spraying circulation water or steam into the drum; and a guide unit formed at one side of the nozzle unit and guiding circulation water or steam to be evenly sprayed into the drum from the nozzle unit.

To achieve the above objects, there is also provided a washing machine including: a steam generator for generating steam; a circulation pump for pumping circulation water discharged from a tub and re-supplying the circulation water into a drum; and a spray device connected to the steam generator by a steam supply unit and to a circulation pump by a circulation line so as to spray steam or circulation water into the drum, of which the spray device includes: a main body connected to the steam supply line and the circulation line; a spray unit formed at an end portion of the main body and spraying steam or circulation water into the drum; a steam passage formed inside the main body and supplying steam introduced through the steam supply line to the spray unit; and a circulation water passage formed inside the main body and supplying circulation water introduced through the circulation line to the spray unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
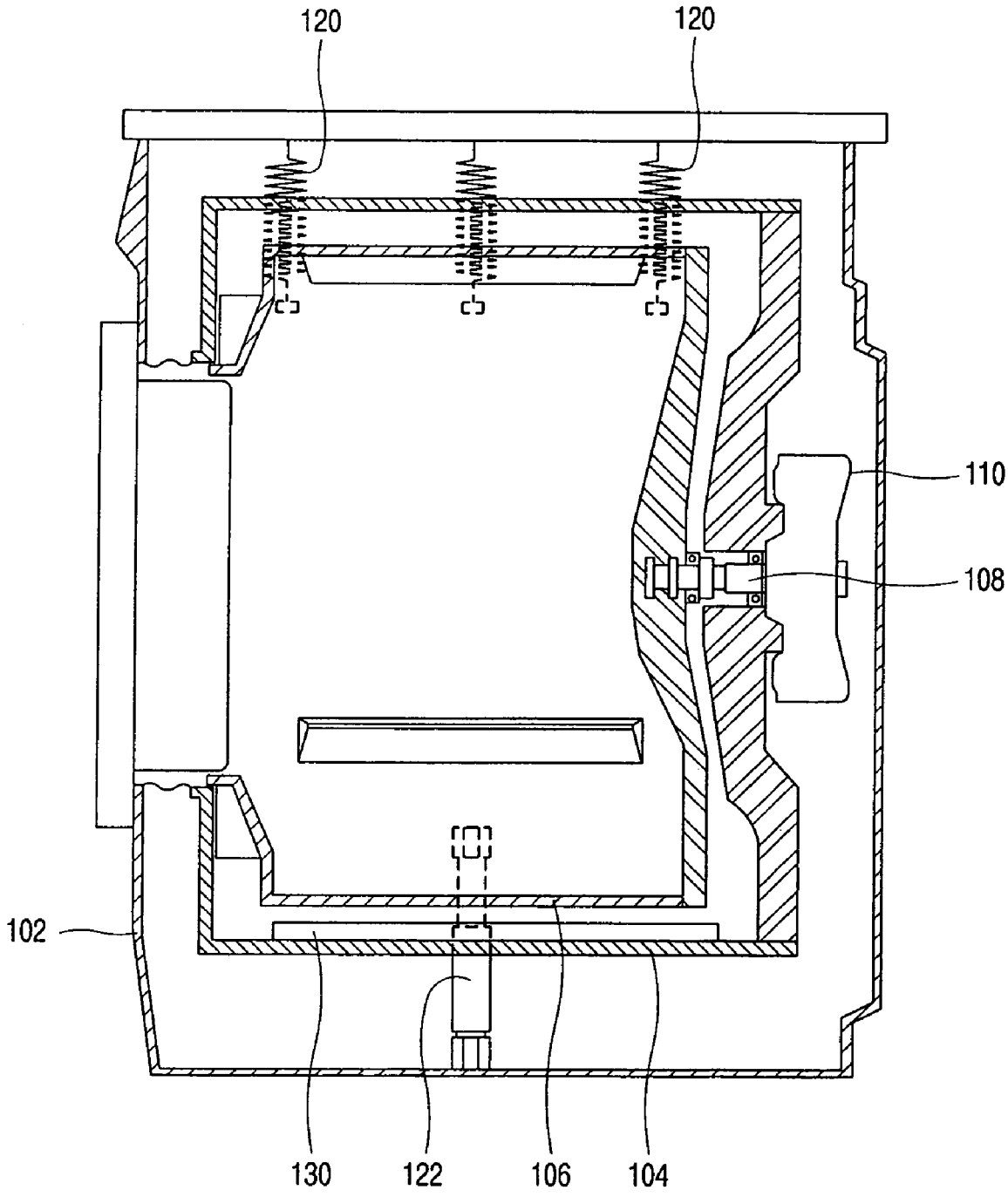
FIG. 1 CONVENTIONAL ART
FIG. 1 is a sectional view of a washing machine in accordance with a conventional art.
Figure 2:
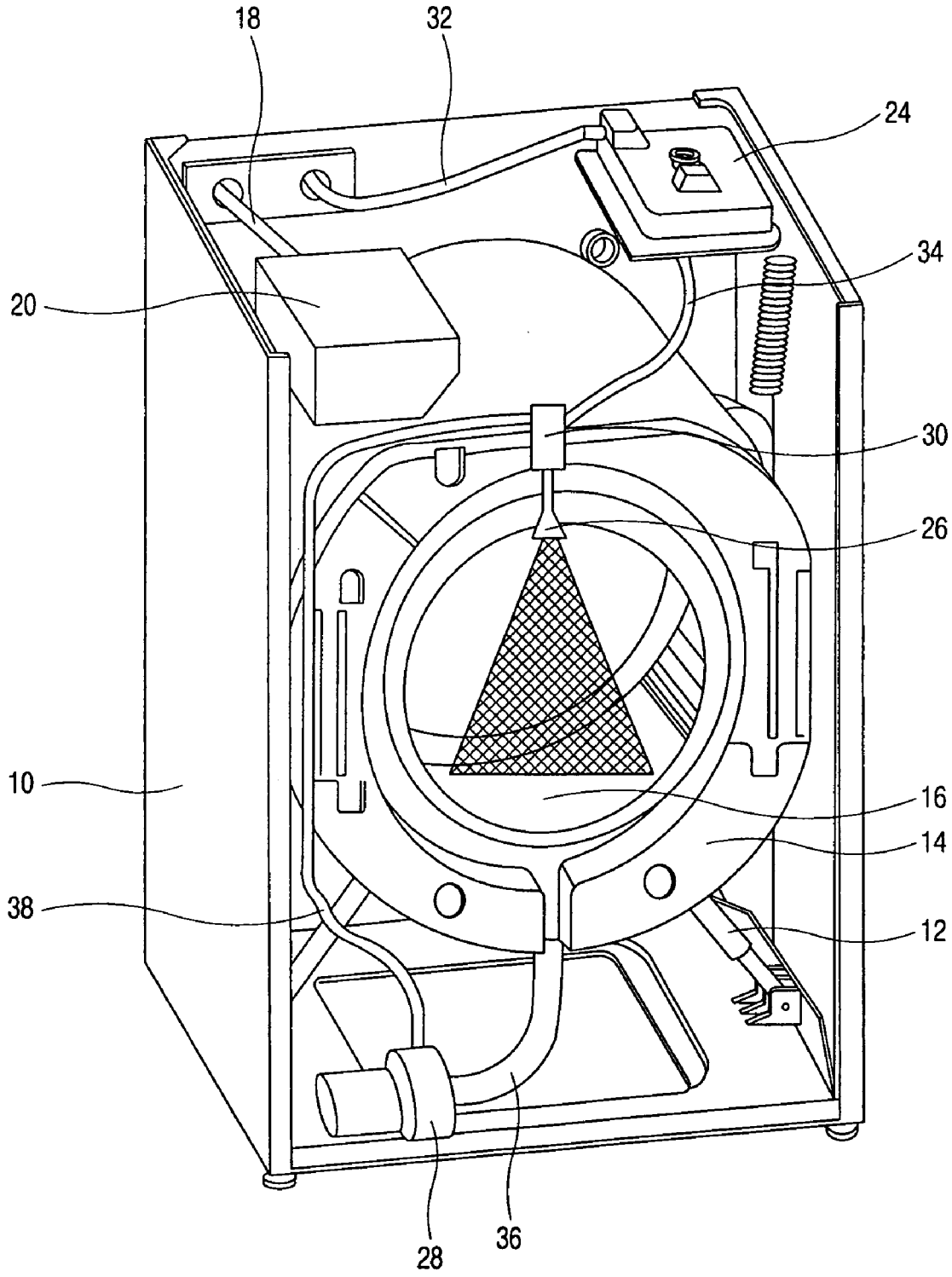
FIG. 2 is a perspective view with a front side of a washing machine opened in accordance with the present invention.

FIG. 2 is a perspective view with a front side of a washing machine opened in accordance with the present invention.

A washing machine in accordance with one embodiment of the present invention includes: a cabinet 10 configuring the exterior; a tub 14 for buff-supported by a damper 12 inside the cabinet 10 and storing washing machine; a drum 16 rotatably disposed inside the tub 14 and performing washing and dewatering operation of the laundry; a heating unit disposed at an upper side of the cabinet 10 and spraying steam into the drum to heat the laundry; and a water circulation unit for re-supplying water discharged from the drum into the drum.

A detergent box 20 is installed at an upper side of the tub 14 connected to a water supply tub 18, through which a detergent and water required for washing are supplied into the tub 14.

The heating unit includes a steam generator 24 for generating steam and a spray nozzle 26 for spraying steam generated from the steam generator 24 into the drum 16.

The steam generator 24 is connected to a water supply tube 32 so as to receive water from an external source, includes a heater (not shown) therein in order to heat water to be supplied by the water supply tube 32, and is connected to the spray nozzle 26 by a steam supply line 34.

The water circulation unit includes a discharge tube 36 connected to a lower portion of the drum 16 to discharge water from the drum 16, a circulation pump 28 connected to the discharge tube 36 and pumping water discharged from the discharge tube 36, a circulation line 38 for re-supplying circulation water pumped from the circulation pump 28 to the drum 16, and a spray nozzle 26 for re-supplying circulation water circulated in the circulation line 38 into the drum 16.

The spray nozzle 26 used for the heating unit and the spray nozzle 26 used for the circulation unit are the same spray nozzle. That is, the spray nozzle 26 sprays either steam supplied through the steam supply line 34 or circulation water circulated through the circulation line 38 into the drum 16.

Thus, a back-current preventing branch unit 30 is provided in order to prevent steam supplied through the steam supply line 34 from flowing back to the circulation line 38 when steam is sprayed from the spray nozzle 26, or in order to prevent circulation water circulation through the circulation line 38 from blowing back to the steam supply line 34 when circulation water is sprayed from the spray nozzle 26.

Figure 3:
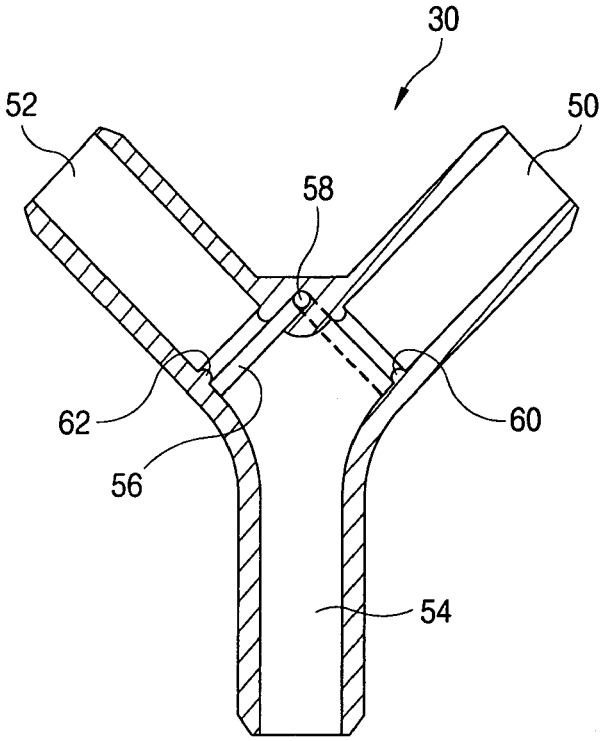
FIG. 3 is a sectional view of a back-current preventing branch unit in accordance with a first embodiment of the present invention.

As shown in FIG. 3, the back-current preventing branch unit 30 includes a steam supply unit 50 connected to the steam supply line 34 and provided with steam, a circulation water supply unit 52 branched from the steam supply unit 50 at a predetermined angle, connected to the circulation line 38, and provided with circulation water, a nozzle connection unit 54 communicating with the steam supply unit 50 and the circulation water supply unit 52 so as to be connected to the spray nozzle 26, and a back-current preventing plate 56 for preventing either the steam supply unit 50 or the circulation water supply unit 52 in order to prevent steam or circulation water from flowing backward.

The back-current preventing plate 56 has a circular shape, and rotatably mounted at a position where the steam supply unit 50 and the circulation water supply unit 52 are branched by a hinge pin 58.

When steam is supplied, the back-current preventing plate 56 closes the circulation water supply unit 52 by virtue of a pressure of steam to thereby prevent steam from flowing back to the circulation water supply unit 52. When circulation water is supplied, the back-current preventing plate 56 closes the steam supply unit 50 by virtue of a pressure of the circulation water to thereby prevent circulation water from flowing back to the steam supply unit 50.

Tightly-attaching protrusions 60 and 62 are formed at an inner circumferential surface of the steam supply unit 50 and an inner circumferential surface of the circulation water supply unit 52, at which the back-current preventing plate 56 is tightly attached.

The tightly-attaching protrusions 60 and 62 are protrusively formed in a circular ring shape at the inner circumferential surface of the steam supply unit 50 and the circulation water supply unit 52.

Figure 4:
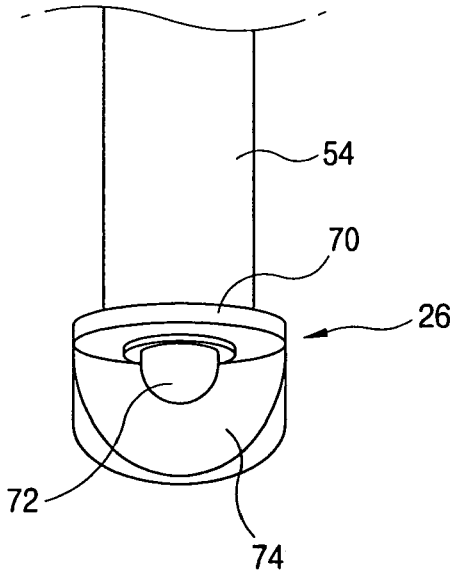
FIG. 4 is a side view of a spray nozzle in accordance with the first embodiment of the present invention.

As shown in FIG. 4, the spray nozzle 26 is provided with a flange unit 70 engaged at an end portion of the nozzle connection unit 54 of the back-current preventing branch unit, a nozzle unit 72 formed at a lower surface of the flange unit 70 and spraying water or steam, and a guide unit 74 for guiding water or steam to be uniformly sprayed into the drum from the nozzle unit 72. The guide unit 74 has a predetermined curved surface, so that circulation water or steam sprayed from the nozzle unit 72 can be uniformly sprayed to the laundry.

Figure 5:
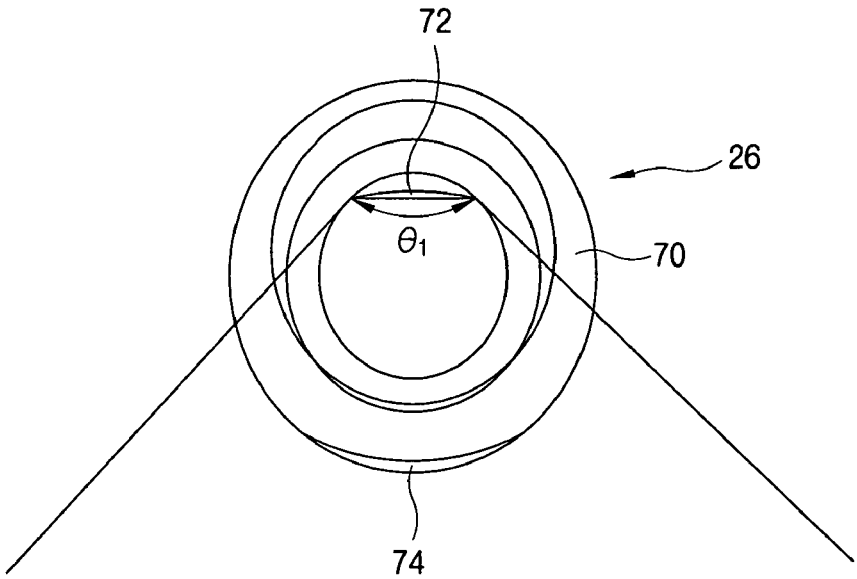
FIG. 5 is a bottom view of the spray nozzle in accordance with the first embodiment of the present invention.
Figure 6:
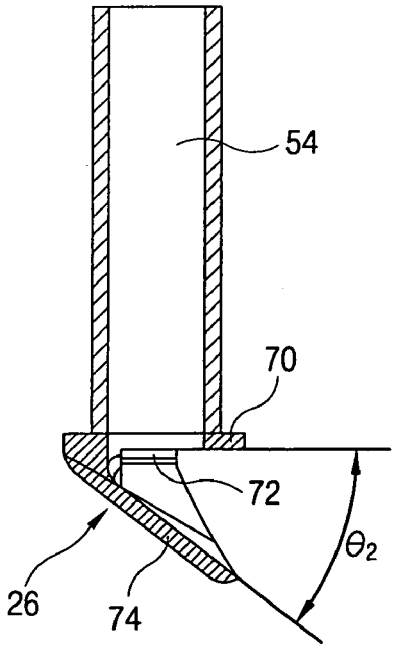
FIG. 6 is a sectional view of a back-current preventing branch unit in accordance with the first embodiment of the present invention.

The spray nozzle 26 has a predetermined spray angle so that circulation water or steam can be uniformly sprayed to the laundry. That is, as shown in FIG. 5, preferably, a horizontal spray angle ($\theta 1$), at which circulation water or steam is sprayed in a horizontal direction, is approximately greater than 90° but smaller than 100° ($90° < \theta 1 < 100°$), and as shown in FIG. 6, preferably, a vertical spray angle ($\theta 2$), at which circulation water or steam is sprayed in a vertical direction, is approximately greater than 35° but smaller than 40° ($35° < \theta 2 < 40°$).

The operation of the washing machine in accordance with the present invention constructed as described above will now be explained.

First, after the laundry is received in the drum 16, an operation switch is turned on. Then, water is supplied into the tub 14 and then into the steam generator 24 through the water supply tube 32.

Then, the water supplied into the steam generator 24 is heated by the heater installed in the steam generator 24 to generate steam, which is supplied to the spray nozzle 26 through the steam supply line, and then the spray nozzle 26 uniformly sprays steam to the laundry inside the drum 16.

At this time, since the steam supply line 34 and the back-current preventing branch unit 30 are connected to each other, when steam is introduced into the steam supply unit 50, the back-current preventing plate 56 is rotated centering around the hinge pin 58 by virtue of a pressure of steam so as to be tightly attached to the circulation water supply unit 52 to close the circulation water supply unit 52.

Then, steam introduced into the steam supply unit 50 is supplied to the spray nozzle 26 through the nozzle connection unit 54, and in this respect, since the circulation water supply unit 52 is closed by the back-current preventing plate 56, the steam is prevented from flowing back to the circulation water supply unit 52.

When the steam spray operation is completed and a washing stroke is performed, the circulation pump 28 is driven so that water stored in the drum 16 is discharged through the discharge tube 36, circulated in the circulation line 38 by a pumping force of the circulation pump 28, and sprayed into the drum 16 through the spray nozzle 26.

The circulation line 38 is connected to the circulation water supply unit 52 of the back-current preventing branch unit 30, so that circulation water is introduced into the circulation water supply unit 52, and the back-current preventing plate 56, which has closed the circulation water supply unit 52 by the pressure of the circulation water, is rotated centering around the hinge pin 58 to close the steam supply unit 50.

Then, the circulation water supplied to the circulation water supply unit 52 is supplied to the spray nozzle 26 through the nozzle connection unit 54 and sprayed into the drum 16, and the steam supply unit 50 is closed by the back-current preventing plate 56 to prevent the circulation water from flowing back to the steam supply unit 50.

Figure 7:
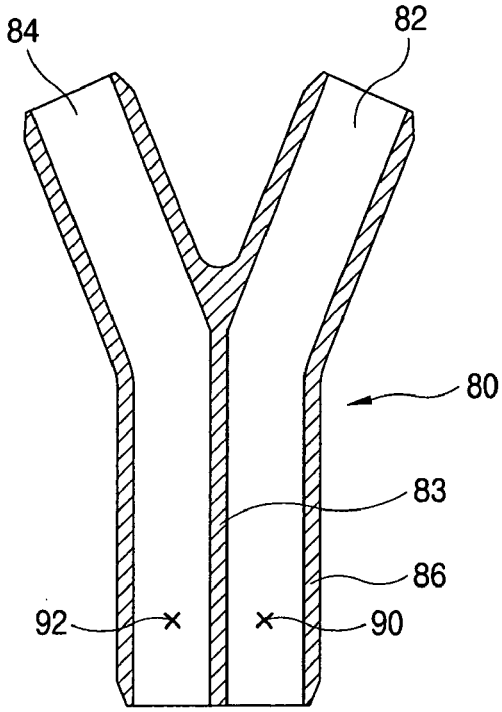
FIG. 7 is a sectional view of a back-current preventing branch unit in accordance with a second embodiment of the present invention.

FIG. 7 is a sectional view of a back-current preventing branch unit in accordance with a second embodiment of the present invention.

A back-current preventing branch unit 80 in accordance with a second embodiment of the present invention includes a steam supply unit 82 connected to the steam supply line 34 and provided with steam; a circulation water supply unit 84 branched from the steam supply unit 82 at a predetermined angle, connected to the circulation line, and provided with circulation water; a nozzle connection unit 86 communicating with the steam supply unit 82 and the circulation water supply unit 84 so as to be connected with the spray nozzle 26; and a partition wall 83 formed in a longitudinal direction at the center of the nozzle connection unit and partitioning a steam supply passage and a circulation water supply passage.

The partition wall 83 divides the nozzle connection unit 86 into two parts at a position where the steam supply unit 82 and the circulation water supply unit 84 are branched, preparing two passages 90 and 92, of which one passage 90 communicates with the steam supply unit 82 to supply steam and the other passage 92 communicates with the circulation water supply unit 84 to supply circulation water, thereby preventing steam from flowing back to the circulation water supply unit 84 or circulation water from flowing back to the steam supply unit 82.

Figure 8:
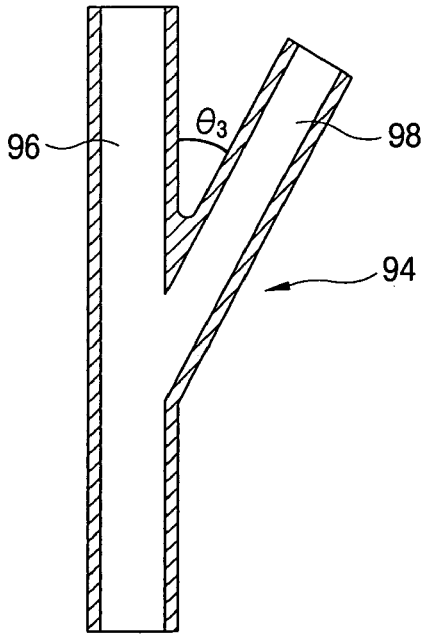
FIG. 8 is a sectional view of a back-current preventing branch unit in accordance with a third embodiment of the present invention.

FIG. 8 is a sectional view of a back-current preventing branch unit in accordance with a third embodiment of the present invention.

A back-current preventing branch unit 94 in accordance with a third embodiment of the present invention includes a first supply unit 96 connected to one of the steam supply line 34 and the circulation line 38 and supplying steam or circulation water directly to the spray nozzle 26, and a second supply unit 98 branched at a predetermined angle from one side of the first supply unit 96 and supplying the other remaining one to the spray nozzle 26.

The first supply unit 96 is formed linearly and supplies one of steam and circulation water directly to the spray nozzle 26, and the second supply unit 98 is branched at a predetermined angle from one side of the first supply unit 96 to supply the other remaining one to the spray nozzle 26, thereby preventing steam or circulation water from flowing backward.

Preferably, the second supply unit 98 is disposed to make 30° or smaller angle from the first supply unit 96.

Figure 9:
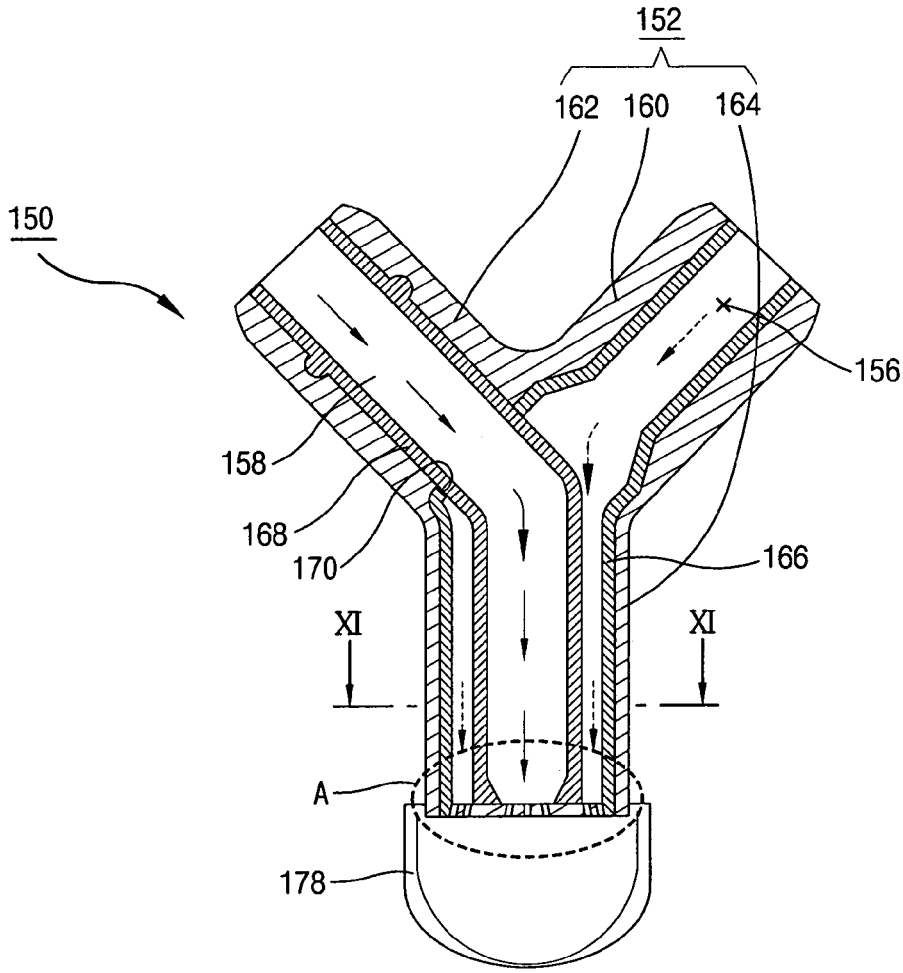
FIG. 9 is a sectional view of a spray device of a washing machine in accordance with a fourth embodiment of the present invention.
Figure 10:
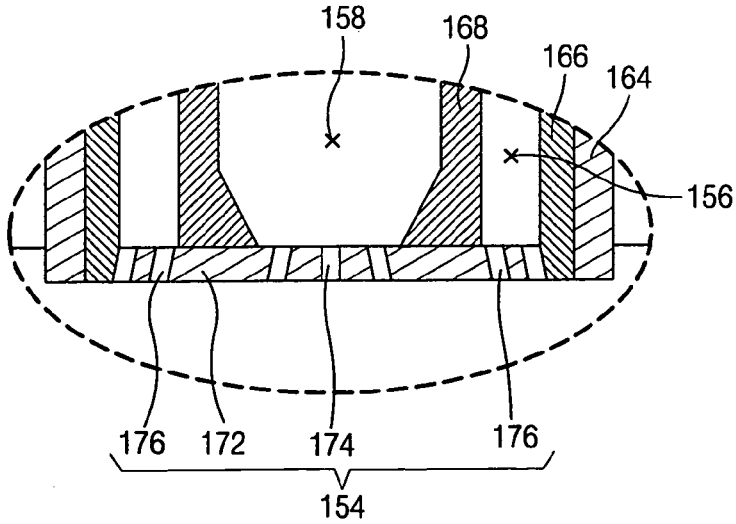
FIG. 10 is an enlarged view showing a portion 'A' of FIG. 9.
Figure 11:
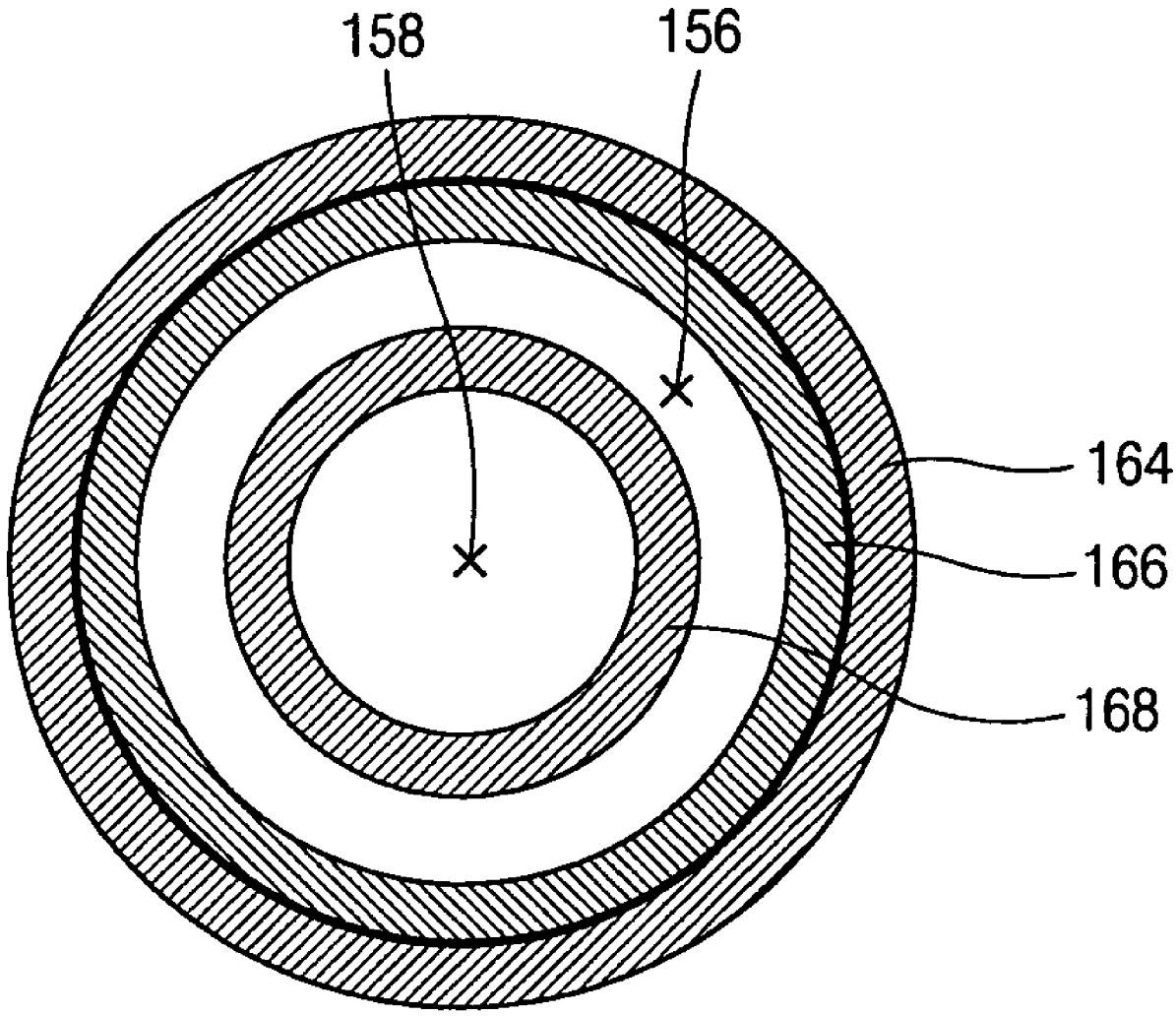
FIG. 11 is a sectional view taken along line XI-XI of FIG. 9.

FIG. 9 is a sectional view of a spray device of a washing machine in accordance with a fourth embodiment of the present invention, FIG. 10 is an enlarged view showing a portion 'A' of FIG. 9, and FIG. 11 is a sectional view taken along line XI-XI of FIG. 9.

A washing machine in accordance with the fourth embodiment of the present invention includes a steam generator 24 for generating steam, a circulation pump 28 for pumping circulation water discharged from the tub 14 and re-supplying the circulation water into the drum 16; and a spray device 150 connected to the steam generator 24 by the steam supply line 34 and to the circulation pump 28 by the circulation line 38, and spraying either steam or circulation water into the drum.

The spray device 150 includes a main body 152 connected to the steam supply line 34 and the circulation line 38, a spray unit 154 formed at an end portion of the main body 152 and spraying either steam or circulation water into the drum 16; a steam passage 156 formed inside the main body 152 and guiding steam supplied in the steam supply line to the spray unit 154; and a circulation water passage 158 formed inside the main body 152 and guiding circulation water supplied in the circulation line 38 to the spray unit 154.

The main body 152 includes a steam supply unit 160 connected to the steam supply line 34 and supplying steam to the main body 152; a circulation water supply unit 162 branched at a predetermined angle from the steam supply unit 160 and connected to the circulation line 38 so as to receive circulation water; and a connection unit 164 communicating with the steam supply unit 160 and the circulation water supply unit 162 and having a spray unit 154 at its end portion so as to supply either steam or circulation water to the spray unit 154.

A steam pipe 166 is installed with a steam passage 156 for supplying steam introduced to the steam supply unit 160 to the spray unit 154 at an inner circumferential surface of the steam supply unit 160 of the main body 152, and a circulation water pipe 168 is installed with a circulation water passage 158 for supplying circulation water introduced into the circulation water supply unit 162 at an inner circumferential surface of the circulation water supply unit 162.

The steam pipe 166 is disposed to be tightly attached to an inner circumferential surface of the steam supply unit 160 and to an inner circumferential surface of the connection unit 164, and a through hole 170 is formed at one side thereof, through which the circulation water pipe 168 passes.

The circulation water pipe 168 is tightly attached to an inner circumferential surface of the circulation water supply unit 162 and disposed inside the steam pipe 166 after passing through the through hole 170 formed at the pipe 166.

The steam pipe 166 has an inner diameter greater than an outer diameter of the circulation water pipe 168 disposed at the connection pipe 164, so that steam passes in the space between the circulation water pipe 168 and the steam pipe 166.

The spray unit 154 includes a plate 172 fixed at an end portion of the connection unit 164 of the main body 152, to which end portions of the steam pipe 166 and the circulation water pipe 168 are fixed; circulation water spray holes 174 formed at the center of the plate 172 and spraying circulation water supplied through the circulation water passage 158; and steam spray holes 176 formed in an outer circumferential direction of the plate 172 and spraying steam supplied in the steam passage 156.

A guide panel 178 is formed at an end portion of the connection unit 164 in order to guide circulation water or steam sprayed from the circulation water spray holes 174 and the steam spray holes 176 to be introduced into the drum 16.

The operation of the branch unit having the nozzle in accordance with the fourth embodiment of the present invention constructed as described above will now be explained.

First, if steam generated from the steam generator 24 is introduced into the steam supply unit 160 of the main body 152 through the steam supply line 34, it is supplied to the spray unit 154 along the steam passage 156 of the steam pipe 166 mounted at the inner circumferential surface of the steam supply unit 160. The steam supplied to the spray unit 154 is sprayed into the drum 16 through the spray holes 176, heating the laundry.

Meanwhile, if circulation water is introduced into the circulation water supply unit 162 through the circulation line 38, it is supplied to the spray unit 154 along the circulation water passage 158 of the circulation water pipe 168 mounted at the inner circumferential surface of the circulation water supply unit 162. The circulation water supplied to the spray unit 154 is sprayed into the drum 16 through the circulation water spray holes 174 of the spray unit 154.

The back-current preventing branch unit in accordance with the fourth embodiment of the present invention separately includes the steam passage 156 for supplying steam into the main body 152, and the circulation water passage 158, to which circulation water is supplied, inside the main body 152, so that steam is sprayed through the steam spray hole while the circulation water is sprayed through the circulation water spray hole of the spray unit. Thus, steam and circulation water are prevented from being mixed with each other.

Figure 12:
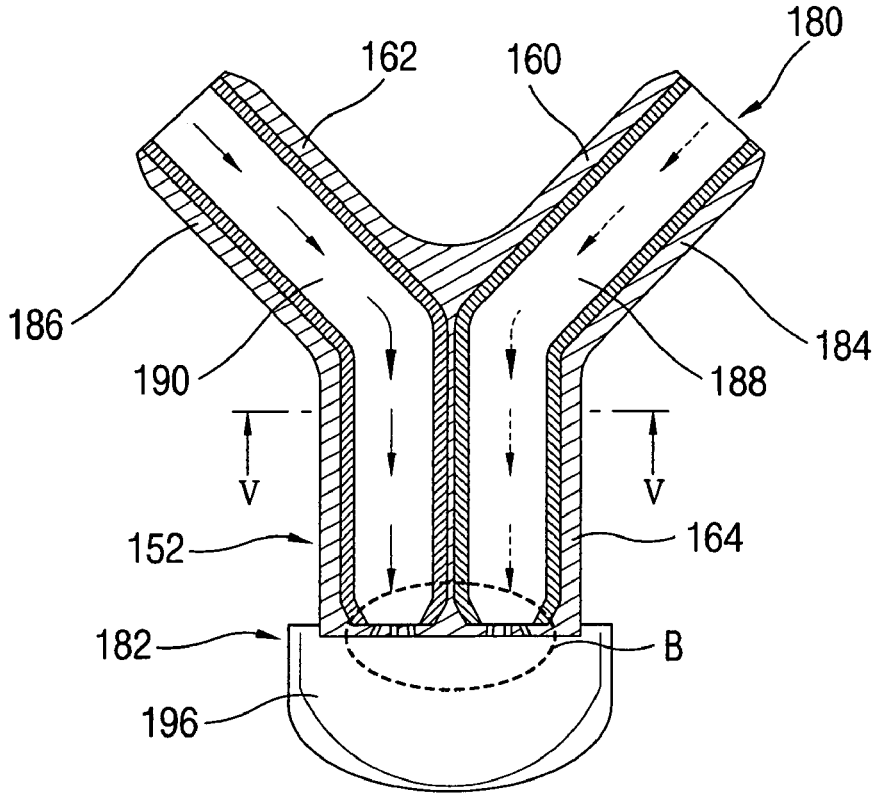
FIG. 12 is a sectional view of a spray device of a washing machine in accordance with a fifth embodiment of the present invention.
Figure 13:
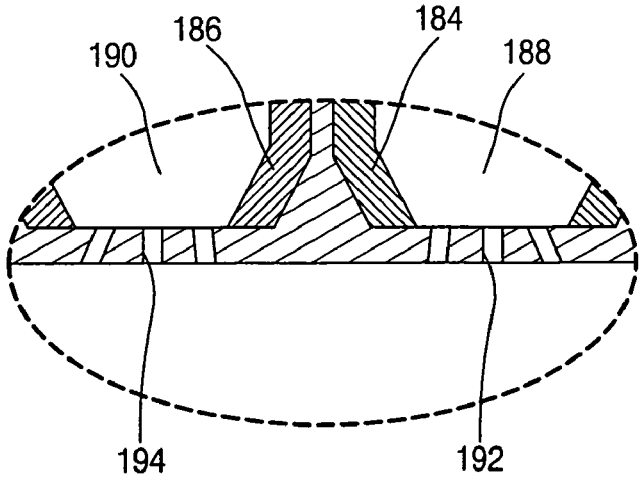
FIG. 13 is an enlarged view of a portion 'B' of FIG. 12.
Figure 14:
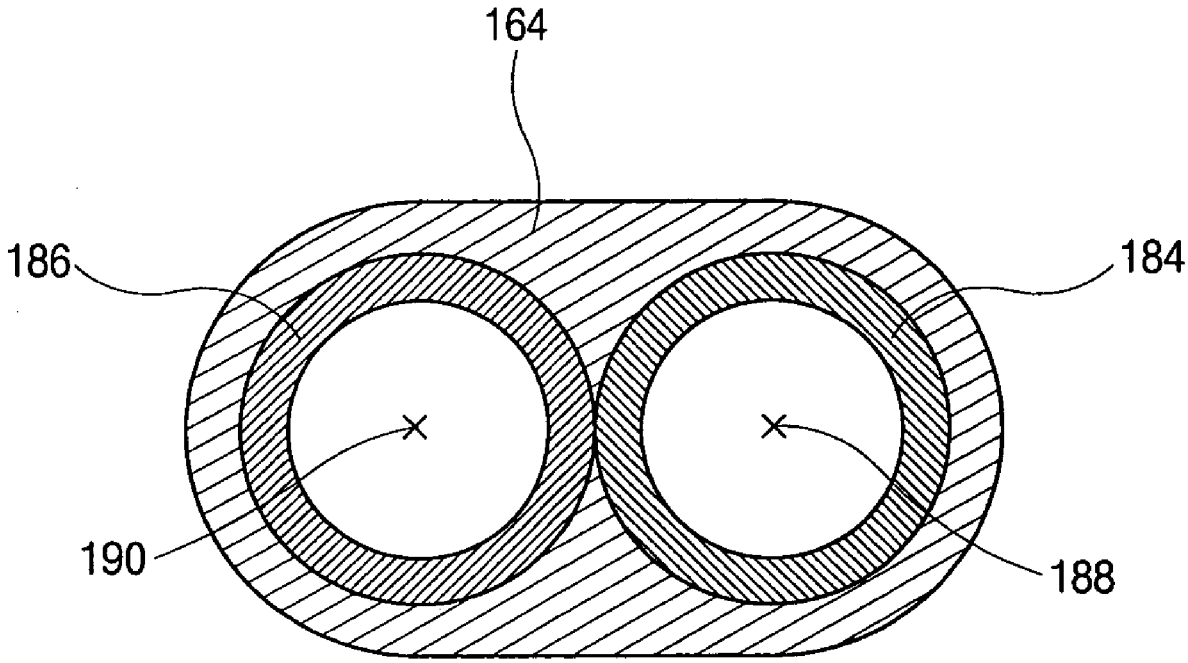
FIG. 14 is a sectional view taken along line V-V of FIG. 12.

FIG. 12 is a sectional view of a spray device of a washing machine in accordance with a fifth embodiment of the present invention, FIG. 13 is an enlarged view of a portion 'B' of FIG. 12, and FIG. 14 is a sectional view taken along line V-V of FIG. 12.

A spray device 180 in accordance with a fifth embodiment of the present invention includes a main body 154 where the steam supply unit 160, the circulation water supply unit 162 and the connection unit 164 are formed, a spray unit 182 formed at an end portion of the connection unit 164 and spraying steam or circulation water; a steam pipe 184 installed at the inner side of the steam supply unit 160 and the connection unit 164 and supplying steam introduced into the steam supply unit 160 to the spray unit 182; and a circulation water pipe 186 installed at the inner side of the circulation water supply unit and the connection unit 164 and supplying circulation water introduced into the circulation water supply unit 162.

The steam pipe 184 includes a steam passage 188 in which steam passes, is tightly attached to the inner circumferential surface of the steam supply unit 160, and connected to the spray unit 182 after passing the inside of the connection unit 164.

The circulation water pipe 186 includes a circulation water passage 190 in which circulation water passes, is tightly attached to the outer circumferential surface of the circulation water supply unit 162, and connected to the spray unit 182 after passing the inside of the connection unit 164.

The spray unit 182 includes a steam spray hole 192 formed at an end portion of the connection unit 164 and spraying steam supplied to the steam passage 188; a circulation water spray hole 194 for spraying circulation water supplied to the circulation water passage 190; and a guide panel 196 for guiding steam or circulation water sprayed through the steam spray hole 192 or circulation water spray through the circulation water spray hole 194, to the drum 16.

As so far described, the heating device of the washing machine of the present invention has the following advantages.

For example, first, since the steam generator is provided to spray steam into the drum to heat the laundry, the overall size of the washing machine can be reduced, the amount of water circulation can be reduced, a power consumption can be minimized, and a washing time can be shortened.

Second, since circulation water circulated by the circulation unit and steam generated from the steam generator are sprayed to the laundry through one spray nozzle, the system can be simplified, and thus, its fabrication cost can be reduced.

Third, since the back-current preventing branch unit is installed between the circulation line, the steam supply line and the nozzle, when steam is sprayed to the spray nozzle, it is prevented from flowing back to the circulation line, or when circulation water is sprayed to the spray nozzle, it is prevented from flowing back to the steam supply line.

Fourth, since steam supplied to the branch unit through the steam supply line and circulation water supplied to the branch unit through the circulation line are supplied to the spray unit through the steam passage and the circulation water passage separately provided in the branch unit, the circulation water and the steam will not be in contact with each other, so a noise can be restrained.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A laundry machine comprising:

a drum disposed inside a cabinet to receive laundry therein, the drum being rotatable about a substantially horizontal axis;

a steam generator configured to generate steam, the steam generator being disposed in the cabinet;

a water supply tube configured to supply water to the steam generator;

a steam supply line connected with the steam generator to supply the generated steam to the drum; and a spray device in communication with the steam supply line to dispense the steam to be sprayed to the drum, wherein the spray device includes a steam discharge hole that is in communication with the steam supply line to discharge the steam and a guide panel placed such that a flowing direction of the discharged steam is changed towards the drum, the steam discharge hole and the guide panel being located in front of the drum at an upper forward portion of the drum such that the flowing direction of the discharged steam via the steam discharge hole is directed from the upper forward portion of the drum to a lower rearward portion of the drum, wherein the guide panel includes a curved surface and a bottom of the guide panel is slanted downwardly to guide the sprayed steam to be evenly dispersed into the drum horizontally and vertically.

2. The laundry machine of claim 1, wherein the spray device is configured as one body.

3. The laundry machine of claim 1, wherein the guide panel guides sprayed steam such that the horizontal spray angle ($\theta 1$) is greater than 90° but smaller than)100° ($90° < \theta 1 < 100°$).

4. The laundry machine of claim 1, wherein the guide panel guides the sprayed steam such that the vertical spray angle ($\theta 2$) is greater than 35° but smaller than 40° ($35° < \theta 2 < 40°$).

5. The laundry machine of claim 1, wherein the spray device is integrally attached to the steam supply line.

6. The laundry machine of claim 1, further comprising:

a water supply line configured to supply wash water to a tub;

a circulation pump configured to circulate the wash water discharged from the tub; and a circulation line configured to re-supply the discharged water into the drum.

7. The laundry machine of claim 6, where the discharged water is sprayed into the drum through a circulation water spray hole.

8. The laundry machine of claim 6, wherein the circulation line is in communication with the spray device.

9. The laundry machine of claim 6, wherein the spray device is integrally attached to the circulation line.

10. The laundry machine of claim 6, wherein the steam supply line and the circulation line are directly connected to the spray device, respectively.

11. The laundry machine of claim 1, wherein a diameter of the discharging hole is smaller than a diameter of the steam supply line.

12. The laundry machine of claim 1, wherein the spray device further comprises a flange extended around the discharge hole.

13. A laundry machine comprising:

a cabinet having an opening to place laundry therethrough;

a drum disposed inside the cabinet to receive laundry therein, the drum being rotatable about a substantially horizontal axis, and the drum having an open end arranged to face the opening;

a steam generator configured to generate steam;

a water supply tube configured to supply water to the steam generator;

a spray nozzle configured to spray the generated steam into the drum through a discharge hole, the discharge hole being located in front of the drum at an upper portion of the open end of the drum;

a steam supply line configured to supply the generated steam to the spray nozzle; and a guide panel placed such that a flowing direction of the steam is changed, the guide panel surrounding at least a portion of the discharge hole and being located between the discharge hole and the opening in the cabinet such that the generated steam is directed away from the opening, wherein the guide panel includes a curved surface and a bottom of the guide panel is slanted downwardly to guide the sprayed steam to be evenly dispersed into the drum horizontally and vertically.

14. The laundry machine of claim 13, wherein the guide panel is formed at one side of the spray nozzle.

15. The laundry machine of claim 13, further comprising:

a water supply line configured to supply wash water to a tub;

a circulation pump configured to circulate the wash water discharged from the tub; and a circulation line configured to re-supply the discharged water into the drum.

16. The laundry machine of claim 15, wherein the water supply tube supplies water to the steam generator independently from the water supply line and the tub.

* * * * *